US005656019A

United States Patent [19]

Cook et al.

[11] Patent Number: 5,656,019

[45] Date of Patent: Aug. 12, 1997

[54] MASSAGE DEVICE

[76] Inventors: Jessie Lee Cook, 13727 Winding Hill, San Antonio, Tex. 78217; William Randall Cook, 2170 Thousand Oaks, No. 416, San Antonio, Tex. 78232

[21] Appl. No.: 378,672

[22] Filed: Jan. 26, 1995

[51] Int. Cl.[6] ..... A61H 15/00

[52] U.S. Cl. ..... 601/128; 601/129

[58] Field of Search ..... 601/134, 135, 601/122–132, 136, 137, 84; 606/201, 204

[56] References Cited

U.S. PATENT DOCUMENTS

| | | | |
|---|---|---|---|
| 681,331 | 8/1901 | Milkman | 601/128 |
| 1,586,031 | 5/1926 | Duncan | 601/137 |
| 1,901,001 | 3/1933 | Rohleder | 601/129 |
| 2,223,263 | 11/1940 | Michaelson | 601/128 |
| 2,633,844 | 4/1953 | Herndon | 601/128 |
| 2,691,978 | 10/1954 | Kirby | 601/129 |
| 4,621,622 | 11/1986 | Beck | 601/128 |
| 5,195,510 | 3/1993 | Svacina | 601/135 |

OTHER PUBLICATIONS

"Original Backnobber" Pressure Positive Co. Sep. 9, 1994.

*Primary Examiner*—Sam Rimell
*Attorney, Agent, or Firm*—David G. Henry

[57] ABSTRACT

The invention is of an improved massage device which is useful in manipulating bodily areas such as the cervical, thoracic and lumbar areas of one's back. The device includes four balls which are interconnected by three wire segments. The balls and the wire segments are relatively arranged whereby the device comfortably fits in the palm of a user's hand, thereby making use of the device as simple and effortless as rubbing the user's palm over the massagee's back.

4 Claims, 3 Drawing Sheets

MASSAGE DEVICE

BACKGROUND OF THE INVENTION

1. Field of the Invention

Applicant's invention relates to apparatus for manipulating or massaging the body.

2. Background Information

Stress, muscle fatigue, back aches, tenseness of the neck and shoulders all seem to evidence the rigors of modern life. An industry with many sub-components has arisen around manipulation of the body to relieve, at least at the physical level, the above signposts of emotional and physical stress and fatigue.

The passage, with slight pressure, of a rounded object over one's back is, for most persons, a very stress-relieving and comfortable action. Various devices have been designed to facilitate this—rollers on the end of handles, tracks of rolling balls, etc.

If a problem surrounds this most pleasurable form of "stress therapy", it is that it requires, as a practical matter, a willing second participant. It is hardly relaxing for one to give himself or herself a self-massage.

The easier and more comfortable the process of giving a back rub with an auxiliary device, the most frequently a hopeful recipient will enjoy the treatment. Rollers on handle ends tend to fatigue a user's hands very quickly because one must constantly resist a rotational force created as the device is pressed against the "patient's" back. Arrays of rollers between handles require two-handed operation, and are also less-than-comfortable to use.

It would be desirable, therefore, to design a device which facilitates a back massage with rounded patient contact points, yet is easy, comfortable and substantially nonfatiguing for the care-giver.

SUMMARY OF THE INVENTION

It is an object of the present invention to provide a novel back massaging device which is easy to use.

It is another object of the present invention to provide an improved rounded patient contact member massaging device.

It is another object of the present invention to provide an improved rounded patient contact member massaging device which is less fatiguing to the user than presently available devices.

It is another object of the present invention to provide an improved rounded patient contact member massaging device which is more compact and less weighty that alternative devices.

In satisfaction of these and related objectives, Applicant's present invention provides a highly effective, easily use, minimally fatiguing, light and compact rounded patient contact massaging device. The device is designed exclusively for single-handed use, and is as easily and comfortable to use as it is to rub the palm of one's hand over a massagee's back.

DETAILED DESCRIPTION OF THE PREFERRED EMBODIMENT

Figure 1:
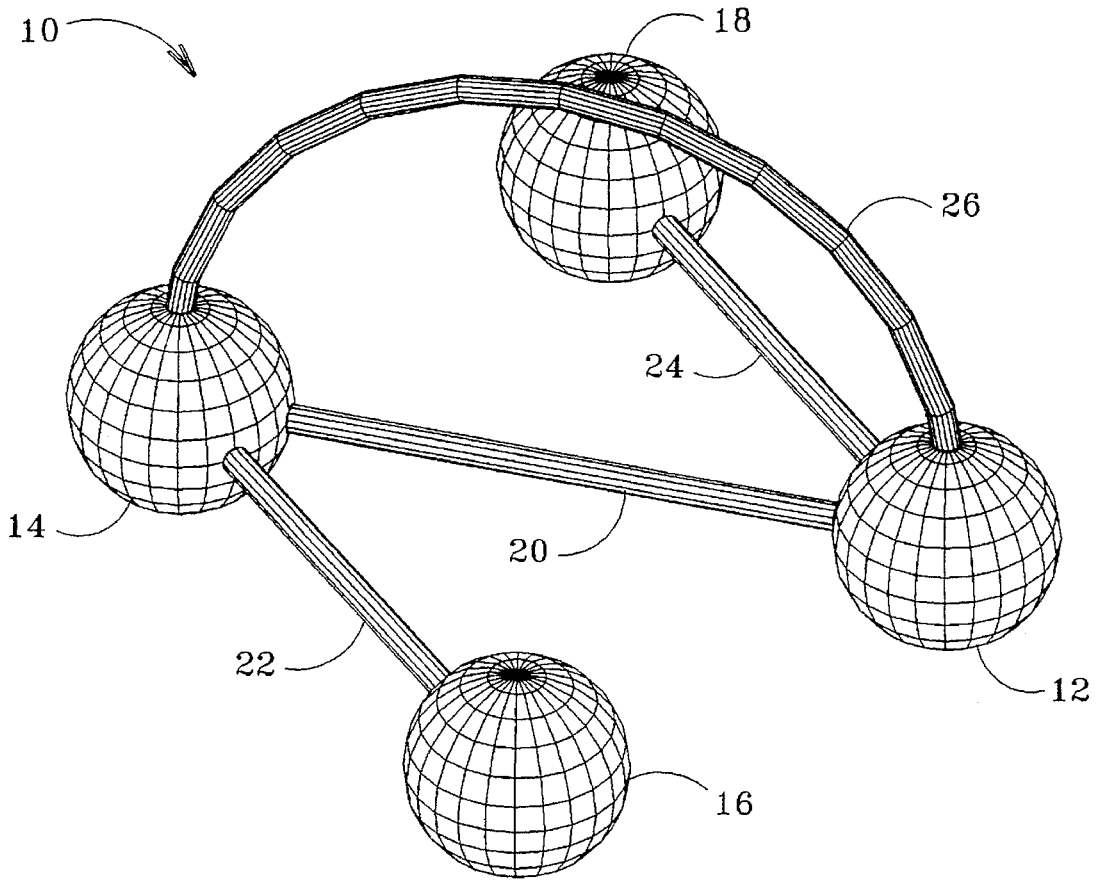
FIG. 1 is a perspective view of the preferred embodiment of Applicant's improved massage device.

Referring to FIG. 1, Applicant's back massaging device is identified generally by the reference numeral 10. Device 10 is clearly a simple device, consisting solely of four balls (12, 14, 16, and 18) interconnected principally by three segments of rigid, metallic wire 20, 22, and 24. A fourth wire segment 26 serves as a harness member as will be explained hereafter.

In the preferred embodiment of Applicant's device 10, balls 12, 14, 16 and 18 are one inch in diameter wooden balls which are coated with a polyurethane coating. Of course, other materials may be substituted, but this configuration is selected, in part, because the wood is more easily drilled and effectively secured to the wire segments than, for example, solid plastic balls.

Wires 20, 22, 24 and 26 are 12 gauge galvanized or stainless steel. The stainless steel wire extend approximately one-fourth of an inch into each ball, and are secured by glue. To further insure a secure mating between the wire segments and the balls, the portion of each wire which extends into a ball may be textured to provide both a frictional engagement as well as an irregular surface with which the glue may more effectively bond (the surface texturing is not shown in the drawings).

Balls 12, 14, 16, and 18 are arranged, in the preferred embodiment of device 10, in a diamond-shaped array. Wire segment 20 is a substantially straight segment and, in the preferred embodiment, spans approximately four inches between balls 12 and 14 with an additional, approximately one-quarter inch of wire extending into and secured within each ball.

Wire segment 22 spans approximately three inches between balls 14 and 16. Wire segment 22 lies in the same plane (a "reference plane" not separately indicated in the drawings) which may be considered as defined by wire segment 20. However, wire segment 22 extends from ball 12 to ball 16 in an orientation which defines an approximately 45° angle with wire segment 20.

Wire segment 24 defines a mirror image of wire segment 22 on the opposite side of wire segment 20. Wire segment 24 spans approximately three inches between balls 12 and 18 and lies in the same plane (a "reference plane" not separately indicated in the drawings) which may be considered as defined by wire segment 20. Wire segment 24 extends from ball 12 to ball 18 in an orientation which defines an approximately 45° angle with wire segment 20 and lies in parallel with wire segment 22 in the preferred embodiment.

Figure 2:
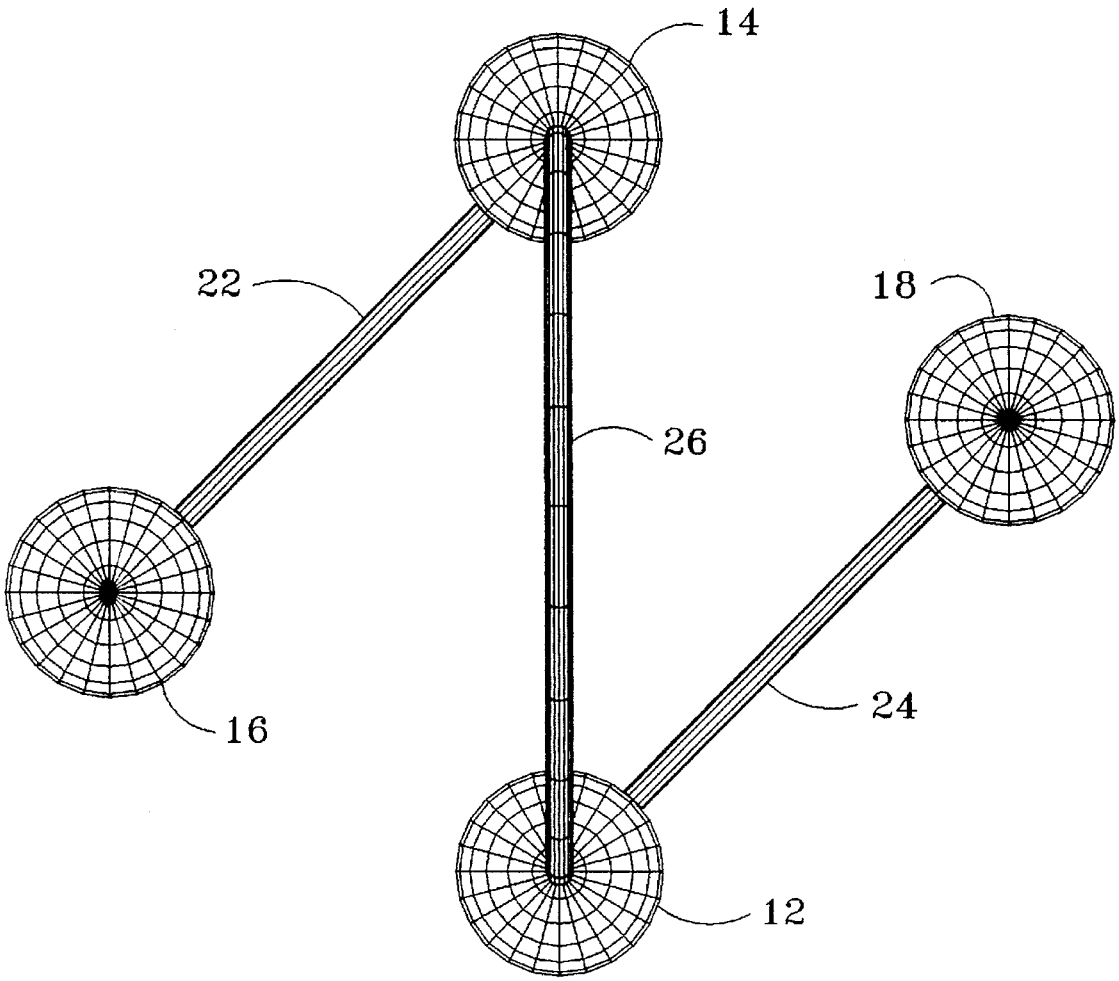
FIG. 2 is a top plan view of the device of FIG. 1.
Figure 3:
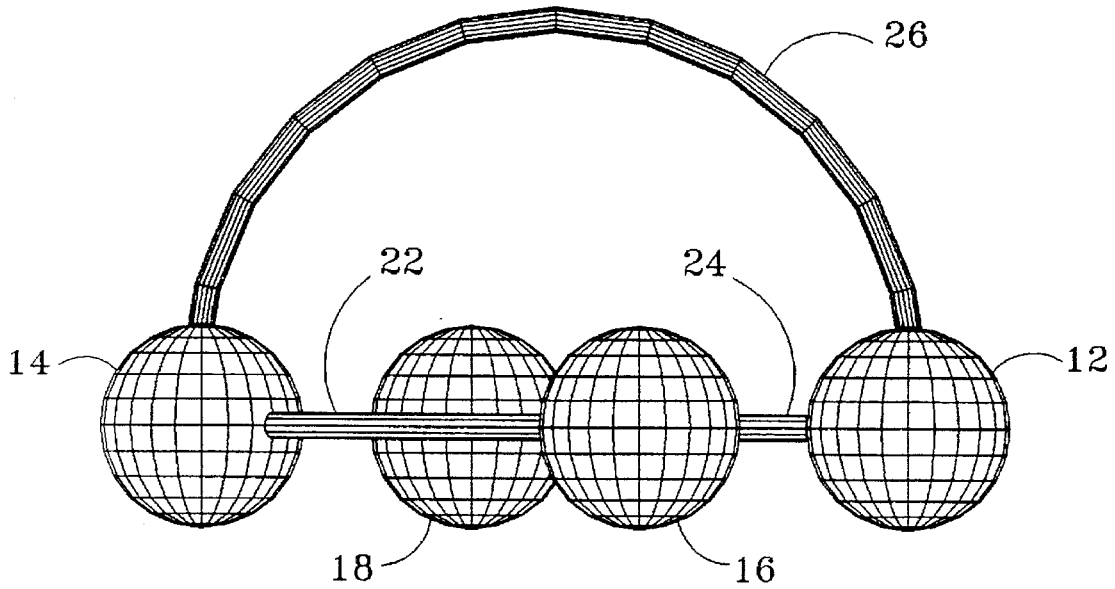
FIG. 3 is a side elevational view of the device of FIG. 1.
Figure 4:
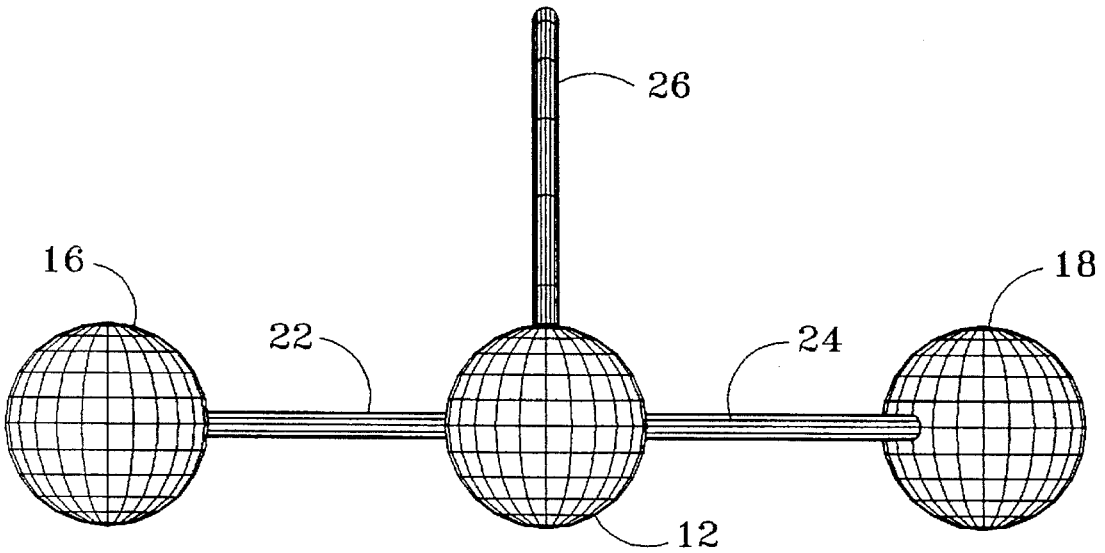
FIG. 4 is a side elevational view of the device of FIG. 1, rotated, relative to the orientation of FIG. 3, about an axis of substantial symmetry of the device.

The relative orientations of wire segments 20, 22 and 24 produces a diamond-shaped array of balls 12, 14, 16 and 18 as is most evident from examination of FIG. 2.

A fourth wire segment, 26, extends non-linearly between balls 12 and 14. In the preferred embodiment, wire segment 26 defines an arc which, at its apex, lies approximately two inches from the mid-point of wire segment 20. Wire segment 26 serves as a harness-like member which overlies the back of a user's hand to comfortably secure the device 10 to the user's hand during use. During such use, a user's palm faces wire segment 20, with the fingertips of the user's hand resting against either ball 16 or 18 and the heel of the hand lying against the opposite ball 18 or 16.

Holding the device 10 in this manner, using device 10 is no more taxing that simply rubbing the user's hand over the massagee's back—no gripping is required, no torque is generated as pressure is applied to the massagee's back and need be resisted by the user, and only one hand is needed to use the device.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A massage device comprising:

a first rounded patient contact member;

a second rounded patient contact member;

a third rounded patient contact member;

a fourth rounded patient contact member;

said first and said second rounded patient contact member being interconnected by a first, substantially linear first wire segment, said first wire segment defining and lying in a reference plane;

said first and said third rounded patient contact member being interconnected by a substantially linear, second wire segment, said second wire segment lying in said reference plane, and being oriented to define an acute angle with respect to said first wire segment;

said second and said fourth rounded patient contact member being interconnected by a substantially linear, third wire segment, said third wire segment lying in said reference plane, and being oriented to both define an acute angle with respect to said first wire segment and lie in a parallel orientation with respect to said second wire segment; and a harness member extending between said first and said second rounded patient contact members, said harness member extending in a substantially arcuate path to thereby define a single lumen bounded by said harness member and said first wire segment and sized for partial insertion therethrough of a user's juxtaposed fingers.

2. The massage device of claim 1 wherein each of said second and third wire segments are of substantially equal length.

3. The massage device of claim 1 wherein each of said first, second and third wire segments are of substantially equal length.

4. The device of claim 1 wherein each of said first, second, third and fourth rounded patient contact members are substantially round balls into which said first, second and third wire segments extend in a secured, anchored linkage.

* * * * *